US005505266A

United States Patent [19]

Fujiki

[11] Patent Number: 5,505,266

[45] Date of Patent: Apr. 9, 1996

[54] RETAINER OPERATING DEVICE FOR AUTOMATIC GAS INJECTION FIRE EXTINGUISHER

[75] Inventor: Masaru Fujiki, Tokyo, Japan

[73] Assignee: Glory Kiki Co., Ltd., Himeji, Japan

[21] Appl. No.: 237,140

[22] Filed: May 3, 1994

[30] Foreign Application Priority Data

Jun. 22, 1993 [JP] Japan ..... 5-038704 U

[51] Int. Cl.[6] ..... A62C 37/42

[52] U.S. Cl. ..... 169/60; 169/11; 169/26

[58] Field of Search ..... 169/11, 19, 26, 169/60; 137/79; 222/5, 54; 239/75

[56] References Cited

U.S. PATENT DOCUMENTS

| | | | |
|---|---|---|---|
| 2,479,801 | 8/1949 | Woodworth | 169/58 |
| 3,889,752 | 6/1975 | Dunn | 169/26 X |
| 3,893,514 | 7/1975 | Carhart et al. | 169/11 X |
| 4,175,677 | 11/1979 | Poeschl et al. | 222/5 |
| 4,377,209 | 3/1983 | Golben | 169/26 |
| 4,848,388 | 7/1989 | Waldbusser | 137/80 |
| 4,972,910 | 11/1990 | Fujiki | 169/60 |
| 5,123,490 | 6/1992 | Jenne | 169/26 X |

FOREIGN PATENT DOCUMENTS

| | | | |
|---|---|---|---|
| 310439 | 4/1989 | European Pat. Off. . | |
| 2-121680 | 5/1990 | Japan . | |
| 1136625 | 12/1968 | United Kingdom | 169/26 |
| 2203646 | 10/1988 | United Kingdom . | |

*Primary Examiner*—Andrew C. Pike
*Attorney, Agent, or Firm*—Browdy and Neimark

[57] ABSTRACT

In order to carry out a two-stage fire extinguishing operation including a cooling fire extinguishing operation and an oxygen deficiency fire extinguishing operation using a fire extinguishing gas, a cylinder filled with a liquefied gas of carbon dioxide is used, and a firing pin unit for breaking a seal member of the cylinder, a retainer for maintaining the firing pin unit in a non-opereted state and a retainer operating device for automatically operating the retainer on the basis of stored temperature data are provided. The retainer is fixed at a head portion thereof by a bolt screwed to the upper surface region of a fixing member, and leg portions of the retainer are fitted in an upper recess in a shaft to a lower end portion of which a pin is fixed. The retainer operating device consists of a retainer turning member provided with projections on one end portion thereof. These projections are positioned on the inner side of the two leg portions of the retainer, and the retainer operating device is turned when a spring of a shape memory metal contracts at a predetermined temperature, to cause the projections to open the leg portions of the retainer, and the pin to be driven.

1 Claim, 4 Drawing Sheets

RETAINER OPERATING DEVICE FOR AUTOMATIC GAS INJECTION FIRE EXTINGUISHER

BACKGROUND OF THE INVENTION

1. Field of the Invention

The present invention relates to a retainer device for an automatic gas injection fire extinguisher.

2. Description of the Prior Art

Various types of fire extinguishers have heretofore been produced. The known fire extinguishers include a gas fire extinguisher provided with a cylinder filled with fire extinguishing gas, such as fluorocarbon gas or carbon dioxide in a liquefied state and adapted to be used by ejecting the gas as a fire extinguishing agent from the cylinder by manually breaking a seal member thereof. There is also a known fire extinguisher adapted to eject a powdered or water soluble fire extinguishing agent by a gas pressure.

Since a gas is ejected by a manual operation when a gas fire extinguisher among these know fire extinguishers is used, it takes time to carry out a fire extinguishing operation. Regarding, especially, a gas fire extinguisher using fluorocarbon gas, the discontinuance of the use of the same gas has been decided under the international treaty for the improvement of the earth environment, so that it is necessary to develop a substitute therefor. When a fire extinguisher adapted to eject powdered or water soluble fire extinguishing agent is used, the machines and tools, clothes, and documents which are installed, stored, or placed in room suffer great damage due to the deposition of the fire extinguishing agent during a fire extinguishing operation.

SUMMARY OF THE INVENTION

Accordingly, it is an object of the present invention to provide an automatic gas injection fire extinguisher having an automatic retainer operating device. The fire extinguisher is capable of improving fire extinguishing performance by utilizing a two-stage fire extinguishing function which is actuated automatically. The first stage has a cooling fire extinguishing function due to a gas of a super-low temperature resulting from gasification of latent heat occurring when a gas, such as carbon dioxide contained in a liquid state in a cylinder, is ejected and gasified. The second stage has a oxygen deficiency fire extinguishing function due to an oxygen deficient condition in the room resulting from the explosive expansion of the liquified gas occurring in the mentioned manner. The fire extinguishing operation is rapidly activated by carrying out the automatic ejection of a gas when a predetermined temperature is reached.

A further object of the present invention is to provide a high-performance automatic gas injection fire extinguisher, capable of carrying out a fire extinguishing operation speedily without soiling various kinds of equipment, documents, curios, and objects of art in a room.

A still further object of the present invention is to provide a retainer operating device utilizing a spring member of a shape memory alloy for an automatic gas injection fire extinguisher, having simple construction and capable of being manufactured at a low cost and assembled easily.

The fire extinguisher according to the present invention comprises a cylinder which is filled with a liquid-state fire extinguishing gas containing at least one of carbon dioxide and nitrogen or a combination of both. The liquified gas has a cooling fire extinguishing function based on latent heat occurring during gasification of liquid-state gas and oxygen deficiency fire extinguishing function based on expansion of the gas due to gasification. The liquified gas is sealed in the cylinder with a seal member. The fire extinguisher has a firing pin unit for breaking the seal member on the cylinder; a cylinder receiving unit for retaining the cylinder and supporting the firing pin unit; a fixing unit for supporting the cylinder receiving unit; a retainer unit for holding the firing pin unit in an inoperative state; and a retainer operating device for releasing the retainer unit at a predetermined temperature, and thereby actuating the firing pin unit.

The fire extinguisher according the present invention is preferably so formed that the retainer operating device includes a spring with a shape memory metal, which contracts at a predetermined temperature.

The fire extinguisher according to the present invention is preferably provided on the fixing unit with a cylindrical member extending so as to surround the cylinder receiving unit and so as to form a clearance between one end portion thereof and an upper surface of the cylinder.

The fire extinguisher according to the present invention is preferably so formed that the cylinder has a thread on the outer circumferential surface of a head portion thereof. The cylinder receiving unit has a first axial bore or hollow portion which communicates with a second axial bore having a slightly larger diameter. This forms a first stepped portion between the bores. A thread is formed in the first axial bore at the first end of the receiving unit which corresponds to the thread on a cylinder. Ejection ports are provided on the receiving unit above its thread. A second stepped portion is formed near the second end of the receiving unit by making the outer diameter of a length of the receiving unit greater than the diameter of its remaining length.

The fire extinguisher according to the present invention is preferably so formed that the firing pin unit consists of a shaft which has a flange at a first end portion thereof. An O-ring is fitted in a first recess at a second end portion of the shaft. The retainer unit is fitted in a second recess on the second end of the shaft. The second recess is spaced above the first recess. The shaft is inserted into the receiving unit. A firing pin projects from the first end portion of the shaft. A spring is provided in a compressed state between the flange of the shaft and the first stepped portion of the receiving unit.

The automatic gas injection fire extinguisher according to the present invention is preferably so formed that the fixing unit consists of a fixing member provided on the inner side thereof with a through bore through which a fire receiving unit is passed. The second stepped portion of the receiving unit engages a third stepped portion on the fixing unit when inserted in the through bore of the fixing unit.

The fire extinguisher according to the present invention is preferably so formed that the retainer unit has a head portion and leg portion which are fitted at the second recess in the second end portion of the shaft of the firing pin unit. A first bolt is inserted into and engages with fixing member of the fixing pin unit so that the head portion of the retainer unit can be engaged to the fixing unit.

The retainer operating device is applied to the fire extinguisher. The fire extinguisher has a cylinder which is filled with a liquid-state fire extinguishing gas containing at least one of carbon dioxide and nitrogen having a cooling fire extinguishing function and an oxygen deficiency fire extinguishing function. The cylinder is sealed with a seal member. The firing pin unit is provided which consists of a shaft, a firing pin projecting from a first end portion of the shaft, and a spring urging the firing pin. The firing pin is adapted to break the seal member of the cylinder when released. A cylinder receiving unit retains the cylinder and supports the firing pin unit. A fixing unit supports the cylinder receiving unit. A retainer unit includes a retainer consisting of a head portion and two leg portions, which are fixed at the head portion via a first bolt screwed to the fixing unit. The two leg portions of the retainer unit are inserted into the second recess formed at the second end portion of the shaft which projects from the end of the firing pin unit. The retainer unit maintains the firing pin unit in an inoperative state.

The retainer operating device comprises a retainer turning member having vertical projections at one end portion thereof. The distance between the projections is substantially equal to the distance between the leg portions of the retainer. The retainer turning member is positioned so that the projections are on the inner side of the leg portions of the retainer. A pin is provided on a part of the fixing member which is on the inner side of the projections so that a pin projects upward from the fixing member. A spring of a shape memory metal is engaged between another end portion of the retainer turning member and the retainer head portion fixing bolt. The spring contracts at a predetermined temperature to release the retainer unit, whereby the firing pin unit is operated.

A plurality of fire extinguishers according to the present invention are set in a predetermined position in a room, a storage space, a cabinet, or a computer room; an engine room; a motor compartment, a panel room, a power source compartment or boiler room in a ship or a vehicle; a container for inflammables; an automatic generator room; a heater room; a depository for valuable; a library; work of art storage room; and a cabinet for inflammable electric appliances and gas fittings. The number of the automatic gas injection extinguishers to be set is regulated suitably on the basis of the capacity or volume of the room, the storage space or the cabinet.

When a fire occurs in a room in which the automatic gas injection fire extinguisher according to the present invention is set, so that the temperature reaches a predetermined level, the spring of a shape memory metal is deformed to press the retainer via the retainer turning member.

Consequently, the retainer thus pressed is opened slightly by the projections of the retainer turning member. Actuation of the firing pin which is prevented by the retainer unit, is moved down owing to the expansive force of the spring provided between the receiving unit and the shaft. The downward movement of the shaft causes the firing pin to be moved down suddenly to break the seal member of the cylinder with its sharp free end portion.

After these steps are carried out, the cylinder is unsealed, and the fire extinguishing gas with which the cylinder is filled is ejected. The gas thus ejected fills the cylindrical member from and is jetted automatically through the clearance formed between the lower portion of the cylindrical member and the cylinder to the space around the cylinder. During this time, the temperature of the gas ejected and gasified becomes super-low, so that the room temperature decreases suddenly, whereby the cool-extinguishing of the fire is carried out. The gasified gas expands explosively to cause the interior of a room or storage to be put in an oxygendeficient condition, whereby the oxygen deficiency extinguishing of the fire is carried out. In the automatic gas injection fire extinguisher according to the present invention, the seal member is broken automatically at a predetermined temperature. Therefore, the time between the breakage of the seal member and the starting of ejection of the fire extinguishing gas is short, and a fire extinguishing operation is started very rapidly. Moreover, the fire extinguishing gas used in the present invention does not cause various kinds of equipment, important goods, and documents to be bathed in water and soiled.

In the retainer operating device for an automatic gas injection fire extinguisher according to the present invention, the spring member can be kept normally expanded, so that it can be formed so as to have a high durability even when the thickness thereof is small. This enables the retainer operating device to have a simple construction, and to be manufactured at a low cost and assembled easily.

The above and other objectives, features, and advantages of the present invention will become apparent from following detailed description which is to be read in conjunction with the accompanying drawings.

DESCRIPTION OF THE PREFERRED EMBODIMENTS

Figure 1:
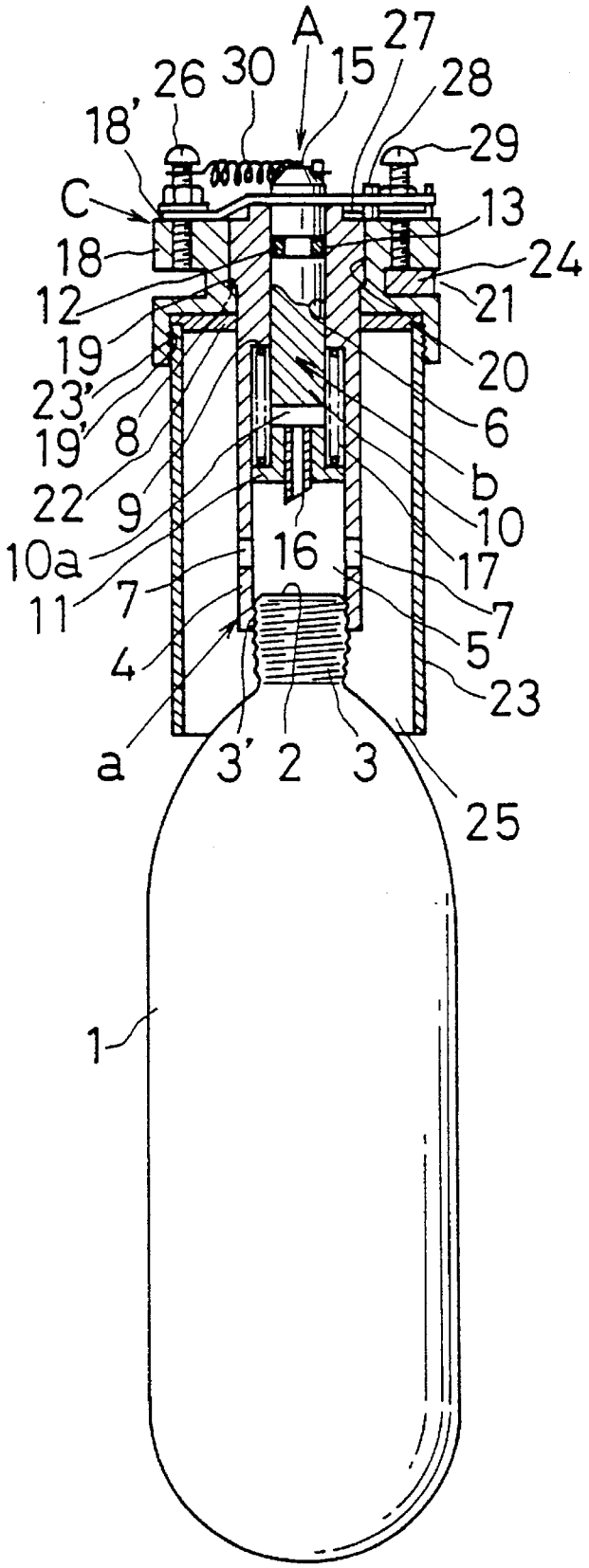
FIG. 1 is a longitudinal section of an embodiment of the automatic gas injection fire extinguisher and a retainer operating device thereof according to the present invention.
Figure 2:
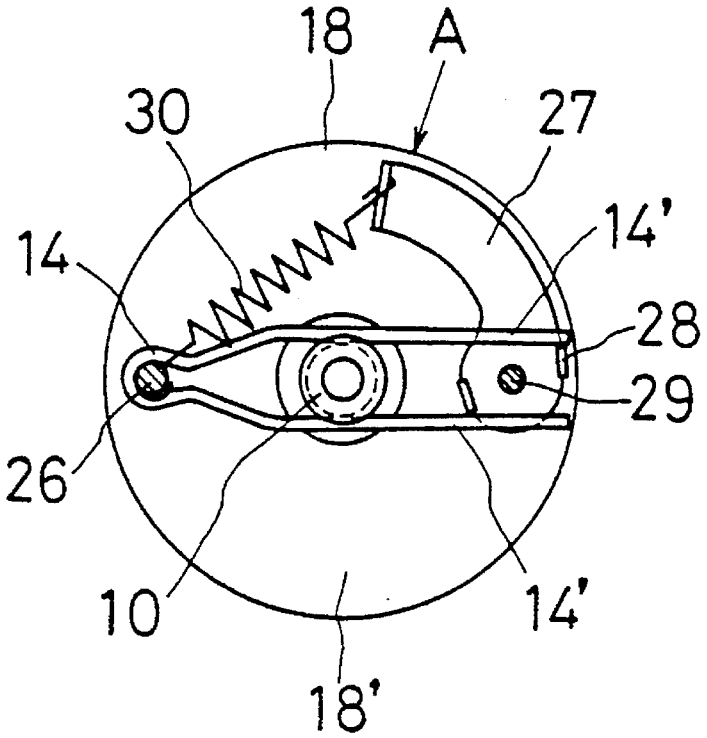
FIG. 2 is a plane view of the embodiment of FIG. 1.

An embodiment of the automatic gas injection fire extinguisher and a retainer operating device thereof according to the present invention will now be described with reference to the drawings.

Referring to the drawings, a reference numeral 1 denotes a cylinder filled with carbon dioxide, nitrogen, or a gas consisting of a mixture thereof in a liquified state for use as a fire extinguishing gas, and sealed with a seal member 2. When this kind of gas is gasified, the temperature thereof becomes super-low (for example, −30°—40° C.), and it therefore has a cooling fire extinguishing function. Since such a gas expands explosively (for example, 500 times) with respect to the volume of the same in a liquified state due to the gasification thereof, an oxygen deficiency fire extinguishing function thereof is displayed if the equipment in a room is regulated so that the gasification quantity becomes about ¼ of the volume of the room. The oxygen deficiency fire extinguishing effect is obtained by reducing the oxygen in a room from 21% to around 15% . A thread 3 is provided on the outer circumferential surface of a head portion of the cylinder 1.

A reference numeral 4 denotes a cylinder receiver having a hollow portion or axial through bore 5 and a through bore 6 which communicate with each other. Liquid gas ejection ports 7 are located in a side wall of the cylinder receiver 4 which has a thread 3' on the inner surface of a lower portion thereof. The head portion of the cylinder 1 is screwed to thread 3' of the cylinder receiver 4. The diameter of the other end portion of the cylinder receiver 4 is slightly larger than that of the above-mentioned end portion thereof, whereby a stepped portion 8 is formed. The hollow portion 5 and through bore 6 are formed so that the diameter of the former is larger than that of the latter, i.e., a joint portion therebetween forms a stepped portion 9. These parts constitute a cylinder receiving unit a.

A reference numeral 10 denotes a shaft inserted in the hollow portion 5 and through bore 6. A lower end portion, which is inserted in the hollow portion 5, of the shaft 10 has flange 11, while an upper end portion thereof which is fitted in the through bore 6 has a recess 13 for fitting an O-ring 12 therein. The shaft 10 is further provided in the portion thereof which is above the recess 13 with a recess 15 for fitting leg portions 14' of a retainer 14 therein. A firing pin 16 which has an axial through hole is projected from one end portion of the shaft 10. The shaft 10 is also provided with a diametrically extending through bore 10*a* communicating with the through hole of firing pin 16. The shaft 10 is inserted in the cylinder receiver 4. A spring 17 is fitted around the shaft 10 so that it can extend in a compressed state between the flange 11 of the shaft 10 inserted in the hollow portion 5 and the stepped portion 9. These parts constitute a firing pin unit b.

A reference numeral 18 denotes a fixing member having a stepped portion 19 on the inner side thereof. Fixing member 18 has a through bore 20 in which the cylinder receiver 4 is fitted, a recess 21 in the outer circumferential surface thereof, and a thread 19' on inner surface of a lower portion thereof. A cylindrical member 23 is screwed to one end portion of the fixing member 18 via a packing 22. An attachment 24 is fitted in the recess 21. The cylinder receiver 4 is fitted from above the fixing member 18. The stepped portion 8 of the cylinder receiver 4 is engaged with a stepped portion 19 of the fixing member 18, and the falling of the cylinder receiver 4 is thereby prevented. These parts constitute a fixing unit c which supports the cylinder receiving unit a.

The cylindrical member 23 is formed to such a length that the lower end of the cylindrical member 23 screwed to one end portion of the fixing member 18 via the packing 22 reaches an inclined portion, which is on the lower side of the head portion, of the cylinder 1 to form a clearance 25 between the lower end portion of the cylindrical member 23 and this inclined portion.

A reference numeral 26 denotes a bolt screwed to an end portion of an upper surface region 18' of the fixing member 18 constituting the fixing unit c. A head portion of a retainer 14 having two legs 14' is fixed by this bolt 26. The two leg portions 14' of the retainer 14 are fitted in recesses 15 formed in an upper portion of the shaft 10 in the firing pin unit b. These parts constitute a retainer unit.

A reference numeral 27 denotes a retainer turning member having at its one end portion a pair of projections 28 the distance between which is substantially equal to that between the leg portions 14' of the retainer 14. This retainer turning member 27 is disposed so that the two projections 28 are positioned between the two leg portions 14' of the retainer 14 which are fitted in the recess 15 in the shaft 10. The retainer turning member 27 is fitted at its central portion on the inner side of the projections 28 around a pin 29 screwed to the fixing member 18, in such a manner that the same member 27 can be turned around the pin 29. A spring 30 of a shape memory metal which shrinks when the temperature thereof reaches a predetermined level (for example, 65°±5° C.) is connected between the other end portion of the retainer turning member 27 and bolt 26 by which the head portion of the retainer 14 is fixed. These parts constitute a retainer operating device.

Figure 3:
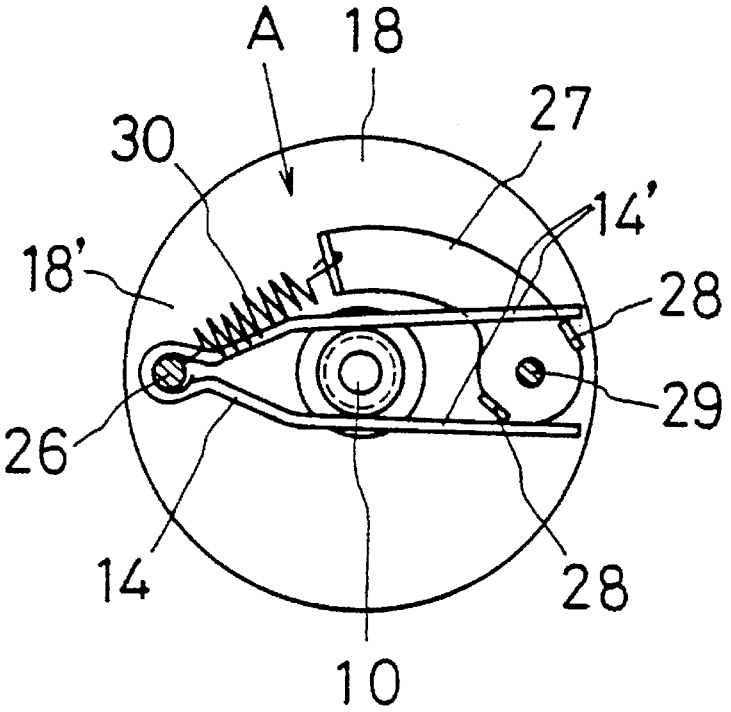
FIG. 3 is a plane view showing the operated condition of the retainer operating device in the embodiment of FIG. 1.
Figure 4:
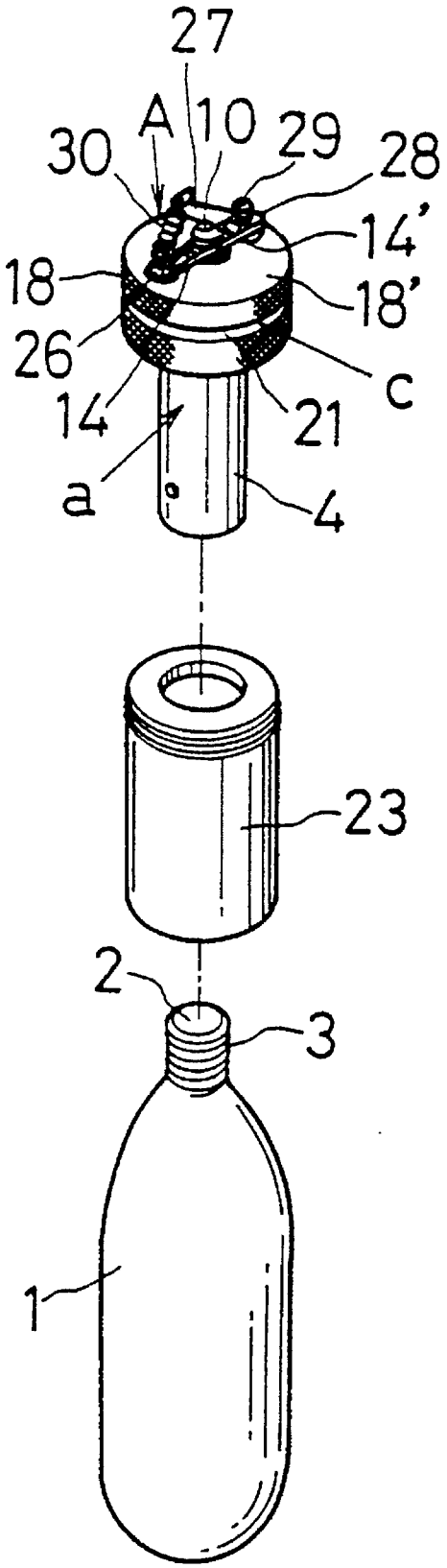
FIG. 4 is an exploded view in perspective of the embodiment of FIG. 1.
Figure 5:
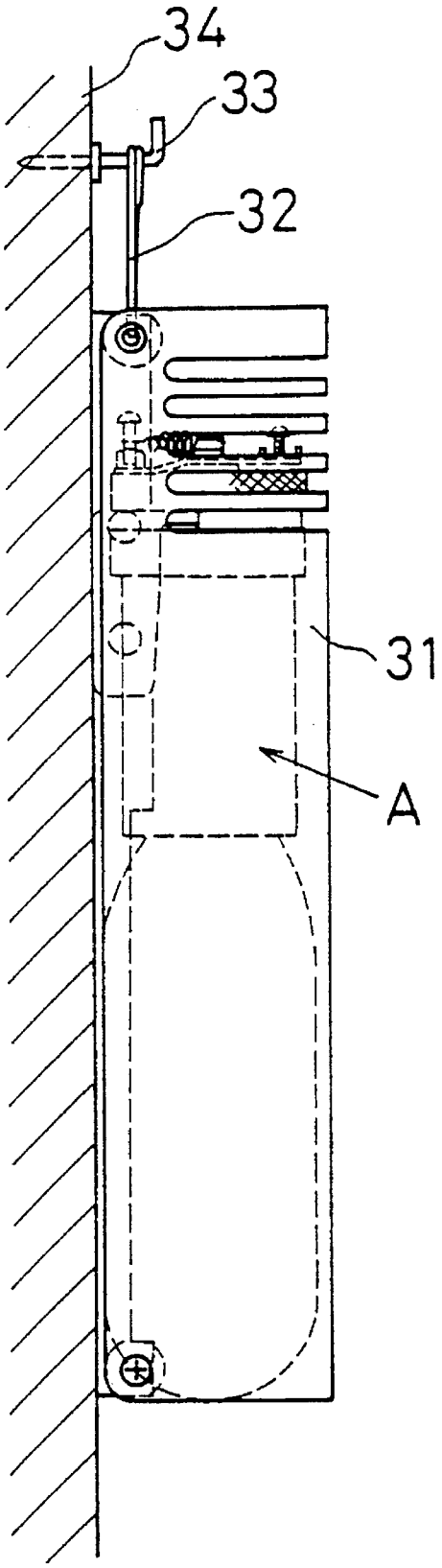
FIG. 5 is a partially sectioned side elevation showing the embodiment in use of FIG. 1.

A reference numeral 31 denotes a cover with which the automatic gas injection fire extinguisher is enclosed, 32 a suspender joined to an upper end portion of the cover 31, and 33 a hook driven into a wall surface 34. When a fire occurs in a room in which the automatic gas injection fire extinguisher thus constructed is installed, so that the temperature reaches a predetermined lever, the spring 30 of a shape memory metal contracts as shown in FIG. 3, to cause the retainer turning member 27 to be turned. When the retainer turning member 27 is turned, the projections 28 press the leg portions 14' of the retainer 14 as shown in the drawing, whereby the retainer 14 is slightly opened. The shaft 10 the flying of which is prevented by the retainer then falls due to the expansive force of the spring 17, and the firing pin 16 is moved down suddenly due to the falling of this shaft, so that the firing pin 16 breaks at its free sharp end the seal member 2 of the cylinder 1.

When the cylinder 1 is thus opened, the fire extinguishing gas contained in the cylinder 1 is then ejected, and this gas passed through the interior of the firing pin 16, the through bore 10*a* and the ejection ports 7 in the cylinder receiver 10, it being ejected to the cylindrical member 23 and thereafter to the outside from the clearance 25 between the cylindrical member 23 and the cylinder 1.

It will be appreciated that modifications may be made in our invention. For example, nozzles may be joined to the ejection ports of the cylinder receiver so that the fire extinguishing gas is ejected from the nozzles directly to the outside without using the cylindrical member.

Accordingly, it should be understood that I intend to cover by the appended claims all modifications falling within the true spirit and scope of my invention.

What is claimed is:

1. A retainer operating device for an automatic gas injection fire extinguisher having a cylinder which is filled with a liquid-state fire extinguishing gas containing at least one of carbon dioxide and nitrogen having a cooling fire extinguishing function based on vaporization latent heat occurring during gasification of said liquid-state gas and an oxygen deficiency fire extinguishing function based on expansion of the gas occurring due to the gasification of said liquid-state gas, and which is sealed with a seal member; a firing pin unit which consists of a shaft, a firing pin projected from one end portion of said shaft, and a spring urging said shaft in a pin projecting direction, said spring being adapted to break said seal member of said cylinder a cylinder receiving unit for retaining said cylinder and supporting said firing pin unit a fixing unit for supporting said cylinder receiving unit and a retainer unit which includes a retainer consisting of a head portion and two leg portions, and which is fixed at the head portion thereof via a bolt screwed to an end portion of an end surface region of a fixing member constituting said fixing unit, and fitted at two leg portion thereof in a recess formed in an end portion of said shaft which said shaft projecting from the end surface region of said fixing member; said retainer unit for maintaining said firing pin unit in a non-operated state; said retainer operating device comprising a retainer turning member having vertical projections at one end portion thereof a distance between which is substantially equal to that between said leg portions constituting said retainer, which retainer turning member is positioned so that said projections are on an inner side of said leg portions of said retainer, and a pin provided on a part of said fixing member which is on an inner side of said projections so that said pin provided on the part of said fixing member projects upward from said fixing member, and a spring of a shape memory metal connected between another end portion of said retainer turning member and said retainer head portion fixing bolt to contract at a predetermined temperature and release said retainer unit, whereby said firing pin unit is operated.

* * * * *